US006047679A

United States Patent [19]

Matsumoto et al.

[11] Patent Number: 6,047,679

[45] Date of Patent: Apr. 11, 2000

[54] CONTROL APPARATUS FOR AN INTERNAL COMBUSTION ENGINE

[75] Inventors: Takuya Matsumoto, Okazaki; Toru Hashimoto, Toyoake; Mitsuhiro Miyake, Kyoto; Seiichi Inoue, Okazaki, all of Japan

[73] Assignee: Mitsubishi Jidosha Kogyo Kabushiki Kaisha, Tokyo, Japan

[21] Appl. No.: 09/061,185

[22] Filed: Apr. 17, 1998

[30] Foreign Application Priority Data

Apr. 25, 1997 [JP] Japan ..... 9-123431
Apr. 25, 1997 [JP] Japan ..... 9-123432

[51] Int. Cl.[7] ..... F02D 1/00

[52] U.S. Cl. ..... 123/396; 123/399

[58] Field of Search ..... 123/361, 399, 123/396

[56] References Cited

U.S. PATENT DOCUMENTS

| | | | |
|---|---|---|---|
| 5,163,402 | 11/1992 | Taguchi et al. | 123/396 |
| 5,383,431 | 1/1995 | Nishimura et al. | 123/399 |
| 5,490,071 | 2/1996 | Akabane | 123/396 |
| 5,727,523 | 3/1998 | Suzuki et al. | 123/399 |
| 5,749,343 | 5/1998 | Nichols et al. | 123/396 |
| 5,755,201 | 5/1998 | Jnoss et al. | 123/396 |
| 5,823,164 | 10/1998 | Seki et al. | 123/396 |

FOREIGN PATENT DOCUMENTS 1-92553 4/1989 Japan .

*Primary Examiner*—John Kwon
*Attorney, Agent, or Firm*—Birch, Stewart, Kolasch & Birch, LLP

[57] ABSTRACT

A control apparatus for an internal combustion engine is applied to vehicles equipped with a so-called drive by wire. When one of several control systems within the control apparatus fails, the drive is urged to obtain repairs. Also, even when all of the several control systems of the drive by wire fail and the failures of these control systems cannot be detected, unpredictable motion of the throttle valve can be prevented, thereby enhancing vehicle safety. The present invention includes a plurality of electronic throttle control systems for electrically driving a throttle valve of an internal combustion engine, a failure detecting mechanism for detecting failures of the electronic throttle control systems, intake air volume control mechanism for driving the throttle valve in a closing direction and also supplying a predetermined intake air volume to the internal combustion engine if it is judged that all electronic throttle control systems have failed, and output suppression mechanism for controlling the driving of the throttle valve by a normal electronic throttle control system and also suppressing output of the internal combustion engine corresponding to the operational quantity of the accelerator pedal if the failure determining mechanism determines that one electronic throttle control system among the several electronic throttle control systems has failed.

16 Claims, 6 Drawing Sheets

CONTROL APPARATUS FOR AN INTERNAL COMBUSTION ENGINE

BACKGROUND OF THE INVENTION

1. Field of the Invention

The present invention relates to a control apparatus for an internal combustion engine which is applied to vehicles equipped with an electronic throttle control unit which electrically drives a throttle valve, called a drive by wire (DBW).

2. Description of Related Art

In engines such as automobile engines, a drive by wire (hereinafter referred to as a DBW) connecting an accelerator pedal (hereinafter referred to as an accel pedal) and a throttle valve together by an electrical signal has hitherto been developed. In a DBW such as this, the accel pedal and the throttle valve are not mechanically connected, and based on a variety of parameters in addition to an operational quantity of the accel pedal (accel opening angle), a virtual accel opening angle ("pseudo" accel opening angle) is set by a computer. Based on this, the throttle valve can be controlled, and the DBW is also referred to as an electronic throttle control unit.

Therefore, for example, during idling where the accel pedal has not been operated (i.e., the accel opening angle is less than a small predetermined value), idling engine speed can be controlled, while the throttle valve is adjusted with fine precision. Also, in accordance with the traveling state of the vehicle and the operating state of the engine, the accel opening angle (driver's operation) is corrected in order to set a pseudo accel opening angle. With the control of the throttle valve based on this, engine running with a feeling of smoothness is realizable.

On the other hand, a spark ignition type in-cylinder injection internal combustion engine (hereinafter referred to as an engine), which is an internal combustion engine that uses sparks by spark plugs to ignite fuel (generally, a gasoline engine) that injects fuel directly into cylinders, has been put to practical use in recent years. In such an engine, an enhancement in the engine fuel consumption performance and an enhancement in the output performance are compatible with each other by making use of the characteristic that fuel injection timing can be freely performed and also the formed state of an air-fuel mixture can be freely controlled.

In other words, in this spark ignition type in-cylinder injection engine, fuel is injected on the compression stroke, and with this, an operation in a state in which fuel is extremely lean (i.e., a super-lean combustion operation in which an air-fuel ratio is extremely higher than a stoichiometric air-fuel ratio) can be performed by stratified-charge combustion. The engine is provided with a super lean operating mode (compression stroke injection mode or lean compression operating mode) as the combustion form and can realize a considerable enhancement in the fuel consumption ratio.

Of course, the spark ignition type in-cylinder injection engine can also perform a premixed combustion operation in which fuel is injected primarily on the intake stroke. In this case, fuel is injected directly into the combustion chamber (cylinder), whereby the greater part of fuel injected at each combustion cycle can be burned with reliability within the combustion cycle. The engine, therefore, can also enhance the engine output.

A premixed combustion operation such as this can also set as combustion form a lean operating mode (lean intake operating mode) which performs operation in a fuel-leaned state which is not as lean as the super lean operating mode (i.e., in a state in which an air-fuel ratio is higher than a stoichiometric air-fuel ratio), a stoichiometric operating mode (stoichiometric feedback operating mode) which performs feedback control on the basis of $O_2$-sensor information so that an air-fuel ratio reaches a stoichiometric air-fuel ratio, and an enriched operating mode (open-loop operating mode) which performs operation in a fuel-enriched state (i.e., in a state in which an air-fuel ratio is lower than a stoichiometric air-fuel ratio).

In general, if a requested output to the engine is small, i.e., if the revolution speed of the engine is low and also the engine load is low, the lean compression operating mode will be selected in order to enhance fuel consumption. As the engine revolution speed and the engine load increase further, the lean intake operating mode, the stoichiometric operating mode, and the enriched operating mode are selected in the recited order.

Incidentally, in the case of the super lean combustion operating mode (lean compression operating mode), there is a need to supply more air to the combustion chamber in order to make an air-fuel ratio high. However, in this lean compression operating mode, since operation is performed when engine load is low, i.e., when the stepping-on quantity of the accel pedal (accel opening angle) is small, the opening angle of the throttle valve corresponding to the accel opening angle cannot satisfy a required air-fuel ratio.

Hence, a technique where an electronically controlled valve (air bypass valve) is arranged in an air bypass passage bypassing an intake-air passage equipped with the throttle valve has been developed. In this technique, when intake air is insufficient at the opening angle of the throttle valve corresponding to the accel opening angle, the air bypass valve is opened based on a required air volume, thereby performing air supply.

Incidentally, applying the aforementioned DBW to the above-mentioned spark ignition type in-cylinder injection engine is also considered. In other words, in the DBW, since the opening angle of the throttle valve can be controlled without corresponding to the accel opening angle, more air than a quantity corresponding to the accel opening angle can be supplied to the combustion chamber. Therefore, for example, in the lean compression operating mode of the spark ignition type incylinder injection engine, even if the accel opening angle is small, a necessary quantity of air can be supplied to the combustion chamber.

In the case where such a DBW is adopted, it is desirable to prepare a counter plan against an unlikely failure of the DBW as well.

For instance, to achieve such a counter plan several sets of sensors are provided in the DBW, such as accel position sensors (APSs) and throttle position sensors (TPSs), and a plurality of sets of actuators for driving a throttle valve.

That is, two sets of sensors and two sets of actuators (these will hereinafter be referred together to as two sets of control systems) are provided, and if one control system fails, the DBW will be controlled by the other of the control system. The DBW is provided with a fail safe system by providing such a duplex control system, whereby safety and durability of the DBW can be enhanced.

Incidentally, in the above-mentioned dual control system of the DBW, when one control system has failed, a warning lamp within the instrument panel, for example, is lit, thereby informing the driver of an abnormality in the sensor or urging the driver to repair.

However, the driver may continue to travel without noticing a warning such as this. Also, even if the driver is aware of a warning such as this, the driver may continue to travel based on the knowledge that the DBW is equipped with a fail safe system such as this, the DBW is controlled by the other normal control system and has no adverse effect on the traveling performance.

However, if the driver continues to travel with one control system failed and, thereafter, the other control system fails, there is a problem that usual traveling will be difficult.

Note that although Japanese Laid-Open Patent Publication No. SHO 64-92553 discloses a technique which can ensure vehicle safety when an accel pedal fails, the disclosed technique is not one which solves the above-mentioned problems.

In addition, in the case where all of the above-mentioned plurality of control systems have failed, if the failures of the control systems should not be detected for some reasons, unpredictable motion of the throttle valve may occur.

Hence, even in the case where all of a plurality of control systems fail and also these failures cannot be detected, there is a desired demand for some counter plan to be prepared for safety.

SUMMARY OF THE INVENTION

The present invention has been made in view of the above-mentioned problems. An object of the present invention is to provide a control apparatus for an internal combustion engine where, when one control system among a plurality of control systems fails in a vehicle equipped with an electronic throttle control unit (drive by wire), the driver is caused to feel the failure of the control system and urged to repair. Another object of the present invention is to provide a control apparatus for an internal combustion engine which prevents unpredictable motion of the throttle valve and enhances vehicle safety, even when all of a plurality of control systems of the drive by wire fail and also the failures of these control systems cannot be detected.

To achieve the aforementioned objects of the present invention, a control apparatus for an internal combustion engine according to the present invention comprises: a plurality of electronic throttle control systems for electrically driving a throttle valve of the internal combustion engine on the basis of an operational quantity of an accel pedal; failure judgment means for judging failure states of the plurality of electronic throttle control systems, the failure judgment means being constituted so that failures of the plurality of electronic throttle control systems can be judged individually; intake air volume control means for driving the throttle valve in a closing direction and also supplying a predetermined intake air volume to the internal combustion engine, in the case where it is judged by the failure judgment means that all electronic throttle control systems have failed; and output suppression means for controlling the driving of the throttle valve by a normal electronic throttle control system and also suppressing output of the internal combustion engine corresponding to the operational quantity of the accel pedal, in the case where it is judged by the failure judgment means that one electronic throttle control system of among the plurality of electronic throttle control systems has failed.

According to such constitution, if a failure of one electronic throttle control system of among a plurality of electronic throttle control systems is detected by the failure judgment means, the throttle valve is driven by a normal electronic throttle control system and also the output of the internal combustion engine corresponding to the operational quantity of the accel pedal is suppressed by the output suppression means. Therefore, there is an advantage of being able to cause the driver to recognize with reliability the failure of one electronic throttle control system. In addition, even in the case the driver continues to travel recognizing a failure of one electronic throttle control system, engine output is suppressed. Therefore, it is possible to cause the driver to recognize the necessity of repair, and safety is enhanced.

Also, in the case where it is judged by the failure judgment means that all electronic throttle control systems have failed, the intake air volume control means drives the throttle valve in a closing direction and also supplies a predetermined intake air volume to the engine.

It is preferable that the output suppression means reduce the degree of change of the throttle valve with respect to the operational quantity of the accel pedal of the driver.

In addition to the above-mentioned constitution, the electronic throttle control system may be constituted by accel opening angle detection means for detecting the operational quantity of the accel pedal, an actuator for opening or closing the throttle valve on the basis of a result of the detection of the accel opening angle detection means, and throttle opening angle detection means for detecting an opening angle of the throttle valve.

At least one of among the accel opening angle detection means, the actuator, and the throttle opening angle detection means may be provided respectively in the plurality of electronic throttle control systems.

According to such constitution, the electronic throttle control system is constituted by the accel opening angle detection means, the actuator for opening or closing the throttle valve, and the throttle opening angle detection means. At least one of among the accel opening angle detection means, the actuator, and the throttle opening angle detection means is provided respectively in the electronic throttle control systems. Therefore, a fail safe system for the electronic throttle control unit can be provided, whereby safety and reliability of the electronic throttle control unit can be enhanced.

The control apparatus according to the present invention may further comprise: a brake switch for detecting an operating state of a brake; and regulation means for regulating an upper limit of the opening angle of the throttle valve, if a failure of one electronic throttle control system of among the plurality of electronic throttle control systems is judged by the failure judgment means and also if the operation of the brake is detected by the brake switch.

According to such constitution, in the case where a failure of one electronic throttle control system of among a plurality of electronic throttle control systems is judged by the failure judgment means and also the operation of the brake is detected by the brake switch, the upper limit of the opening angle of the throttle valve is regulated by the regulation means. Therefore, thereafter, even in the case where failure judgment is not made although the other electronic throttle control system has failed, unpredictable motion of the throttle valve can be prevented, and there is an advantage of being able to enhance vehicle safety.

Also, even if the other electronic throttle control system is normal, when one electronic throttle control system fails, the upper limit value of the opening degree of the throttle valve is clipped if the operation of the brake is detected. Therefore, the driver is caused to recognize an abnormality in the vehicle by the change in the engine output, and there is an advantage of urging the driver to an early repair of the vehicle. With this, there is another advantage of enhancing reliability and safety of the electronic throttle control unit.

Preferably, in addition to the above-mentioned constitution, the plurality of electronic throttle control systems include at least the accel opening angle detection means for detecting the operational quantity of the accel pedal, respectively. Also, the failure judgment means judges failures of the electronic throttle control systems on the basis of a difference in detection information between the plurality of accel opening angle detection means.

According to such constitution, even in the case where dual failure of the accel opening angle detection means is not judged although it has occurred, unpredictable motion of the throttle valve can be prevented with reliability and there is also an advantage of being able to enhance vehicle safety.

BRIEF DESCRIPTION OF THE DRAWINGS

The present invention will be described in further detail with reference to the accompanying drawings wherein.

DESCRIPTION OF THE PREFERRED EMBODIMENTS

If a description will hereinafter be made of an embodiment of the present invention, FIGS. 1 through 6 show an in-cylinder injection internal combustion engine to which a control apparatus for an internal combustion engine as an embodiment of the present invention is applied, and the embodiment will be described based on these figures.

General Description of an In-cylinder Injection Internal Combustion Engine

First, a description will be made of the constitution of a spark-ignition type in-cylinder injection internal combustion engine (hereinafter also called an in-cylinder injection internal combustion engine) in reference to FIG. 2.

Figure 2:
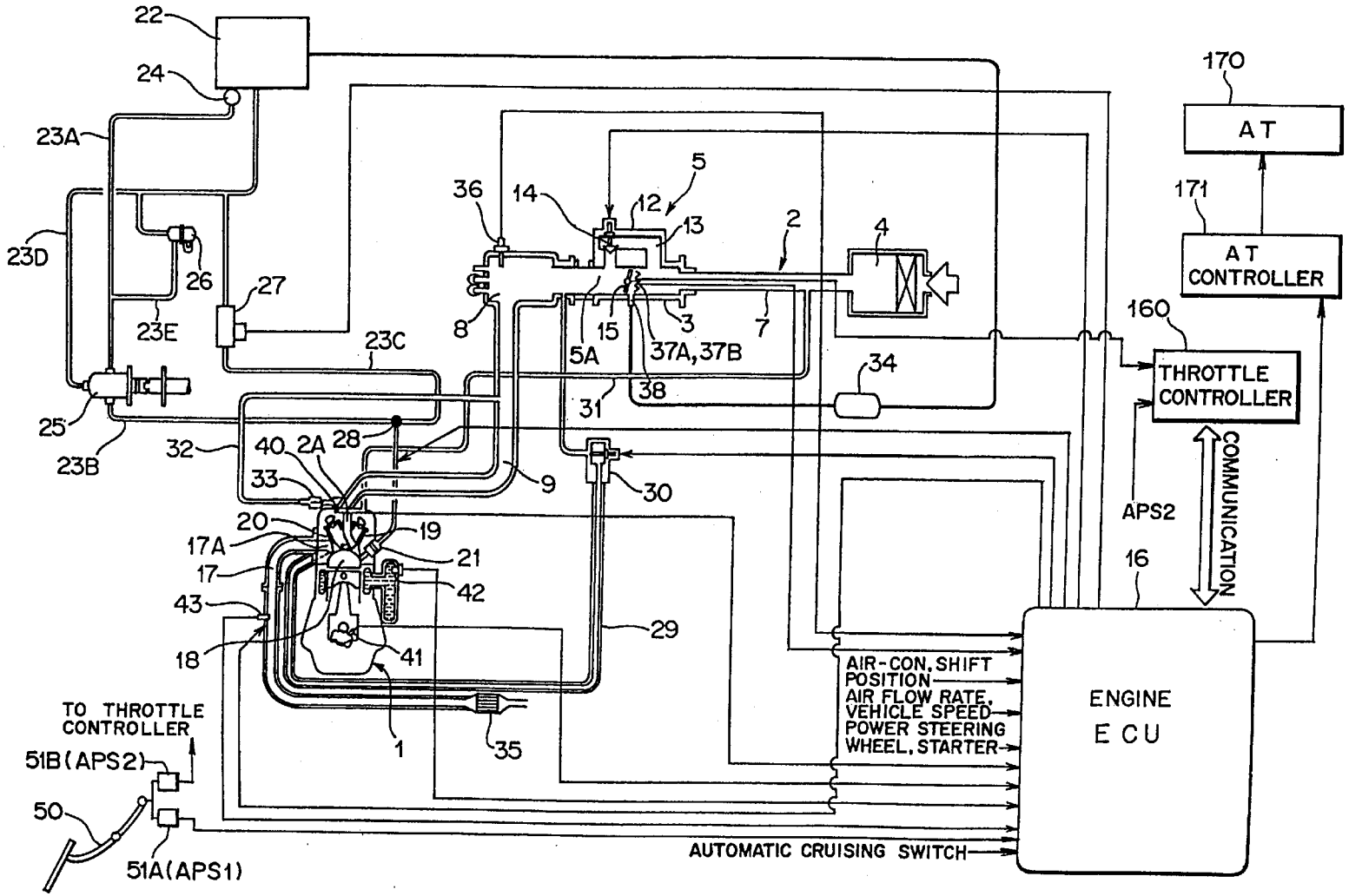
FIG. 2 is a block diagram showing the control apparatus for an internal combustion engine according to the embodiment of the present invention.

In FIG. 2, 1 is an engine main body, 2 an intake passage, 3 a throttle valve installation portion, and 4 an air cleaner. The intake passage 2 is constituted by an intake pipe 7, a throttle body 5, a surge tank 8, and an intake manifold 9, connected in this order from the upstream side.

The throttle body 5 is equipped with an electronically controlled throttle value (intake air volume regulation means) 15. An opening angle of the electronically controlled throttle value 15 is controlled through a throttle control computer (throttle controller) 160 to be described later. A target opening angle of the -throttle valve (target throttle opening angle) is set according to a stepping-on quantity of an accel pedal 50 (accel opening angle) detected with an accel position sensor (TPS1) 51A and an operating state of the engine by an engine control computer (ECU) 16 to be described later.

The electronically controlled throttle value 15, the ECU 16, and the throttle controller constitute an electronic throttle control unit (i.e., a drive by wire (DBW)) 150.

Also, a limp home valve (LHV) 12 is arranged parallel with the electronically controlled throttle value 15. This LHV 12 supplies air so that combustion of the engine is established when the electronically controlled throttle valve 15 has failed (when closed-valve failure has occurred). This failure will be described later. The LHV 12 is constituted by a bypass passage 13 provided on the upstream side of the surge tank 8 so that it bypasses the electronically controlled throttle value 15, and an LHV main body 14 arranged in this bypass passage 13. The LHV main body 14 is driven with a linear solenoid (not shown) which is controlled by the engine control computer (ECU) 16 to be described later.

Also, 17 is an exhaust passage and 18 a combustion chamber. The opening of the intake passage 2 to the combustion chamber 18 and the opening of the exhaust passage 17 to the combustion chamber 18, i.e., an intake port 2A and an exhaust port 17A are provided with an intake valve 19 and an exhaust valve 20, respectively. Furthermore, 21 is a fuel injection valve (injector). In this embodiment, the injector 21 is arranged so as to inject fuel directly into the combustion chamber 18.

In addition, 22 is a fuel tank, 23A through 23E fuel supply paths, 24 a low-pressure fuel pump, 25 a high-pressure fuel pump, 26 a low-pressure regulator, 27 a high-pressure regulator, and 28 a delivery pipe. Fuel within the fuel tank 22 is supplied by the low-pressure fuel pump 24. Furthermore, the fuel is pressurized with the high-pressure fuel pump 25 and supplied in a predetermined high-pressure state to the injector 21 through the fuel supply paths 23A and 23B and the delivery pipe 28. At this time, the fuel pressure discharged from the low-pressure fuel pump 24 is regulated with the low-pressure regulator 26. The fuel pressure, pressurized with the high-pressure fuel pump 25 and guided to the delivery pipe 28, is regulated with the high-pressure regulator 27.

Additionally, 29 is an exhaust gas recirculation passage (EGR passage) which recirculates a portion of the exhaust gas into the intake passage 2. 30 is an EGR valve (exhaust gas volume regulation means), which regulates the recirculation volume of the exhaust gas that is recirculated into the intake passage 2 through the EGR passage 29. 32 is a passage for restoring blow-by gas, 33 a valve for positively ventilating the crank chamber, 34 a canister, and 35 a catalyzer for purifying exhaust gas (here, catalytic converter rhodium (CCRO)).

Incidentally, as shown in FIG. 2, the ECU 16 performs the control of the LHV 12 in accordance with an operating state or failed state of the engine in addition to the drive control of the injector 21, the drive control of the spark wire coils (not shown) which operate spark plugs, the opening angle control of the EGR valve, and the combustion pressure control by the high-pressure regulator 27. The throttle controller 160 also performs the opening and closing control of the electronically controlled throttle value 15 in accordance with the accel instruction of the driver or an operating state or failed state of the engine.

Hence, as shown in FIG. 2, to the ECU 16 detection signals are transmitted from a first accel position sensor (APS1) 51A, an air flow sensor (not shown), an intake-air temperature sensor 36, a throttle position sensor (TPS2) 37B for detecting a throttle opening angle, an idle switch 38, a boost sensor (not shown), an air-con switch (not shown), a shift position sensor (not shown), a wheel speed sensor (not shown), a power steering wheel switch (not shown) for detecting an operating state of a power steering wheel, a starter switch (not shown), a first-cylinder sensor 40, a crank angle sensor 41, a water temperature sensor 42 for detecting temperature of engine cooling water, an 02 sensor 43 for detecting oxygen concentration in exhaust gas, etc. Note that since the revolution speed of the engine can be computed based on the crank angle sensor 41, the crank angle sensor 41 is also called an engine revolution speed sensor for convenience sake.

In addition, as shown in FIG. 2, to the throttle controller 160 detection signals are transmitted from an accel position sensor (APS2) 51B, a throttle position sensor (TPS1) 37A, etc.

The ECU 16 and the throttle controller 160 are constituted so that information can be exchanged therebetween by communication.

Furthermore, this engine is provided with an automatic transmission (AT) 170 and an automatic transmission controller (AT controller) 171 for controlling the automatic transmission 170. Similarly, the ECU 16 and the AT controller 171 are constituted so that information can be exchanged therebetween by communication.

This engine is also equipped with an automatic cruise function, and according to input information relevant to automatic cruising, the throttle opening angle control by the throttle controller 160 is performed.

Such an engine, incidentally, has as operating modes a late lean combustion operating mode (compression stroke injection mode), an early lean combustion operating mode, a stoichiometric feedback operating mode, and an open-loop combustion operating mode. Any of these modes is selected according to an operating state of the engine (i.e., engine revolution speed and engine load) or a traveling state of the vehicle.

Among these modes, the late lean combustion operating mode is a mode in which fuel injection is performed in a stage extremely near ignition timing as in the latter period of the compression stroke and also stratified-charge combustion is performed by collecting fuel near the spark plug in such a manner that the air-fuel ratio is partially rich and lean as a whole. The late leans combustion operating mode is also a super-lean combustion mode in which economical operation can be performed ensuring ignitability and combustion stability. Although this embodiment sets the total air-fuel ratio to an area of about 24 or higher and can realize the leanest combustion, the total air-fuel ratio may be set to a lower area than this embodiment (e.g., a range in which the total air-fuel ratio is about 23 or higher) or may be set to a higher area than this embodiment.

Although the early lean combustion operating mode is also a lean combustion mode, this mode performs fuel injection (primarily on the intake stroke) before the late lean combustion operating mode. The early lean combustion operating mode is a mode in which economical operation is performed by premixing air and fuel so that ignitability and combustion stability are ensured and also a certain degree of output is obtained, while causing the air-fuel ratio to be leaner as a whole than a stoichiometric air-fuel ratio. The area of the early lean combustion operating mode here is set to an area where the total air-fuel ratio is between a stoichiometric air-fuel ratio and about 24.

Also, the stoichiometric feedback combustion operating mode is made on the basis of the output of the $O_2$ sensor so that sufficient engine output is efficiently obtained, while the air-fuel ratio is being maintained in a stoichiometric state. In this mode the premixed combustion based on the fuel injection on the intake stroke is performed.

In addition, in the open-loop combustion operating mode, combustion is performed at a stoichiometric or rich air-fuel ratio by open-loop control so that sufficient output is obtained when the vehicle is accelerated or started. In this mode the premixed combustion based on the fuel injection on the intake stroke is performed.

Each operating mode such as this is selected according to engine revolution speed and engine load by the ECU 16 to be described later. In a low revolution and low load state, the late lean combustion operating mode is usually selected. If engine revolution speed or engine load increases, the operating mode will be switched to the early lean combustion operating mode and the stoichiometric combustion operating mode in this order. If engine revolution speed or engine load increases further, the operating mode will be switched to the open-loop mode (enriched combustion operating mode).

The ECU 16 selects the operating modes in this manner and then performs various controls. However, in the late lean combustion operating mode, in which fuel is injected on the compression stroke and also the air-fuel ratio is extremely high, if attention is paid to throttle value control, air will be insufficient at the opening angle of the throttle value corresponding to the opening angle of the accel pedal in order to achieve a target air-fuel ratio. Therefore, a target opening angle ("pseudo"-target opening angle) considerably greater than the throttle valve opening angle corresponding to the accel opening angle is set, and based on this, the opening angle control of the throttle value is performed. Also, even in the stoichiometric feedback combustion operating mode and the open-loop combustion operating mode, there are cases where air becomes insufficient at the throttle value opening angle corresponding to the accel opening angle. In this case a target opening angle (pseudo-target opening angle) suitably greater than the throttle valve opening angle corresponding to the accel opening angle is set, and based on this, the opening angle control of the throttle value is performed.

Description of an Intake Control System

Figure 1:
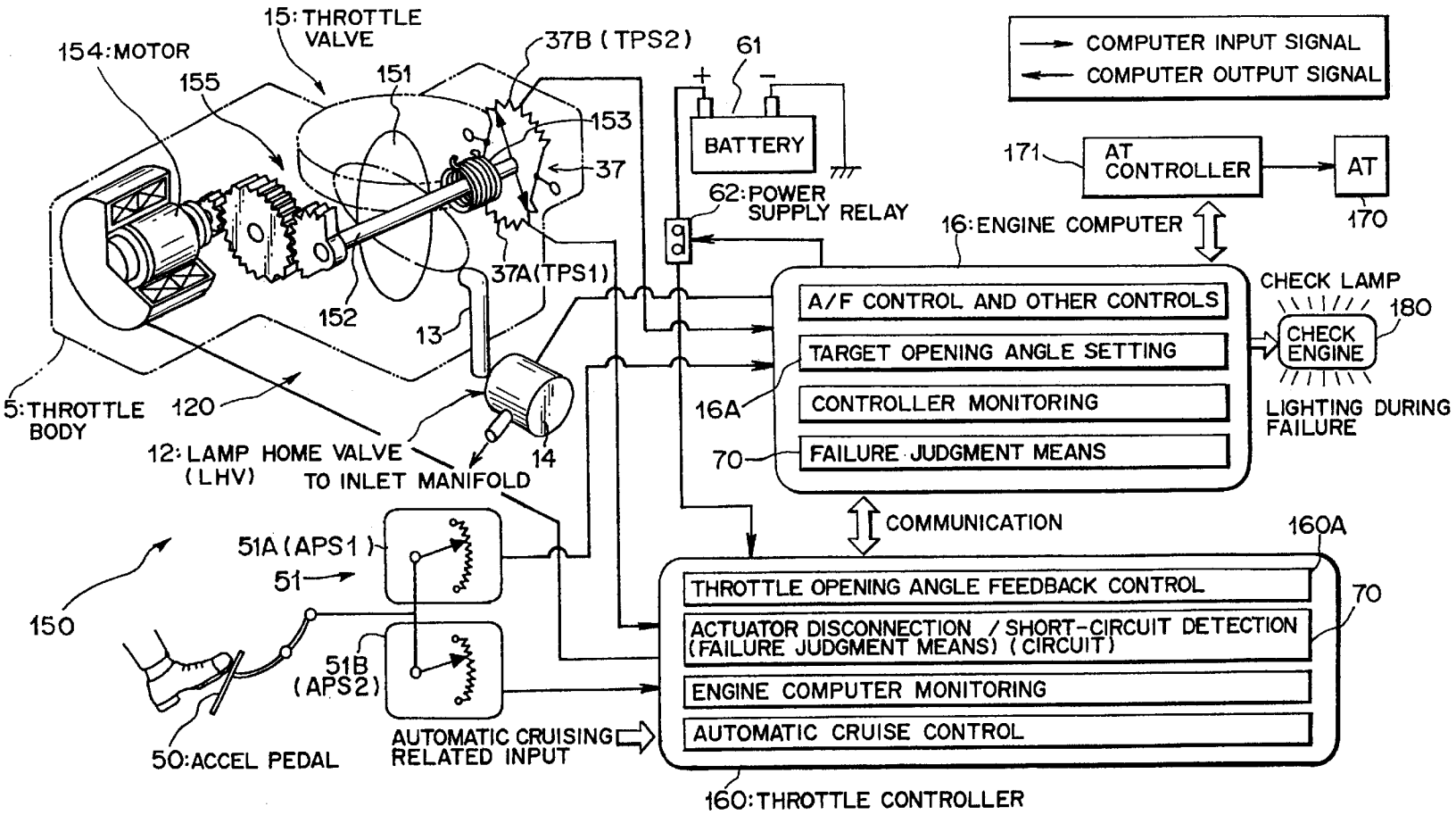
FIG. 1 is a schematic constitution diagram showing the essential parts of a control apparatus for an internal combustion engine according to an embodiment of the present invention.

Now, if a description is made giving attention to both the electronic throttle control unit (DBW) 150 relevant to the control apparatus of the present invention and the control system of the LHV 12 (i.e., limp home valve control unit) 120, these control systems are constituted as shown in FIG. 1.

In other words, the electronically controlled throttle valve 15 constituting the DBW 150 is provided with a butterfly valve 151 arranged in the intake-air passage 5A within the throttle body 5, a return spring 153 arranged so as to surround a shaft 152 supporting the butterfly valve 151 in order to give closing and urging force to the butterfly valve 151, an electric motor (throttle actuator) 154 for rotating the shaft 152, and a gear mechanism 155 interposed between the actuator 154 and the shaft 152.

The shaft 152 is provided with a throttle position sensor 37 for detecting an opening angle of the butterfly valve 151 (throttle valve opening angle). The throttle position sensor 37 consists of a first throttle position sensor (TPS1) 37A and a second throttle position sensor (TPS2) 37B. Thus, the apparatus of the present invention is provided with two throttle position sensors (TPS1 and TPS2) 37A and 37B. The two throttle positions sensors 37A and 37B are provided in case of failure.

The DBW 150 is constituted by the electrically controlled throttle valve 15, the ECU 16 for setting a target opening angle of this electrically controlled throttle valve 15, and the throttle controller 160 for controlling operation of the actuator 154 on the basis of the target opening angle set by the ECU 16 and adjusting an opening angle of the throttle valve.

For this reason, as shown in FIG. 1, the ECU 16 is provided with a target opening angle setting section 16A, and the throttle controller 160 is provided with a throttle opening angle feedback control section 160A.

Figure 3:
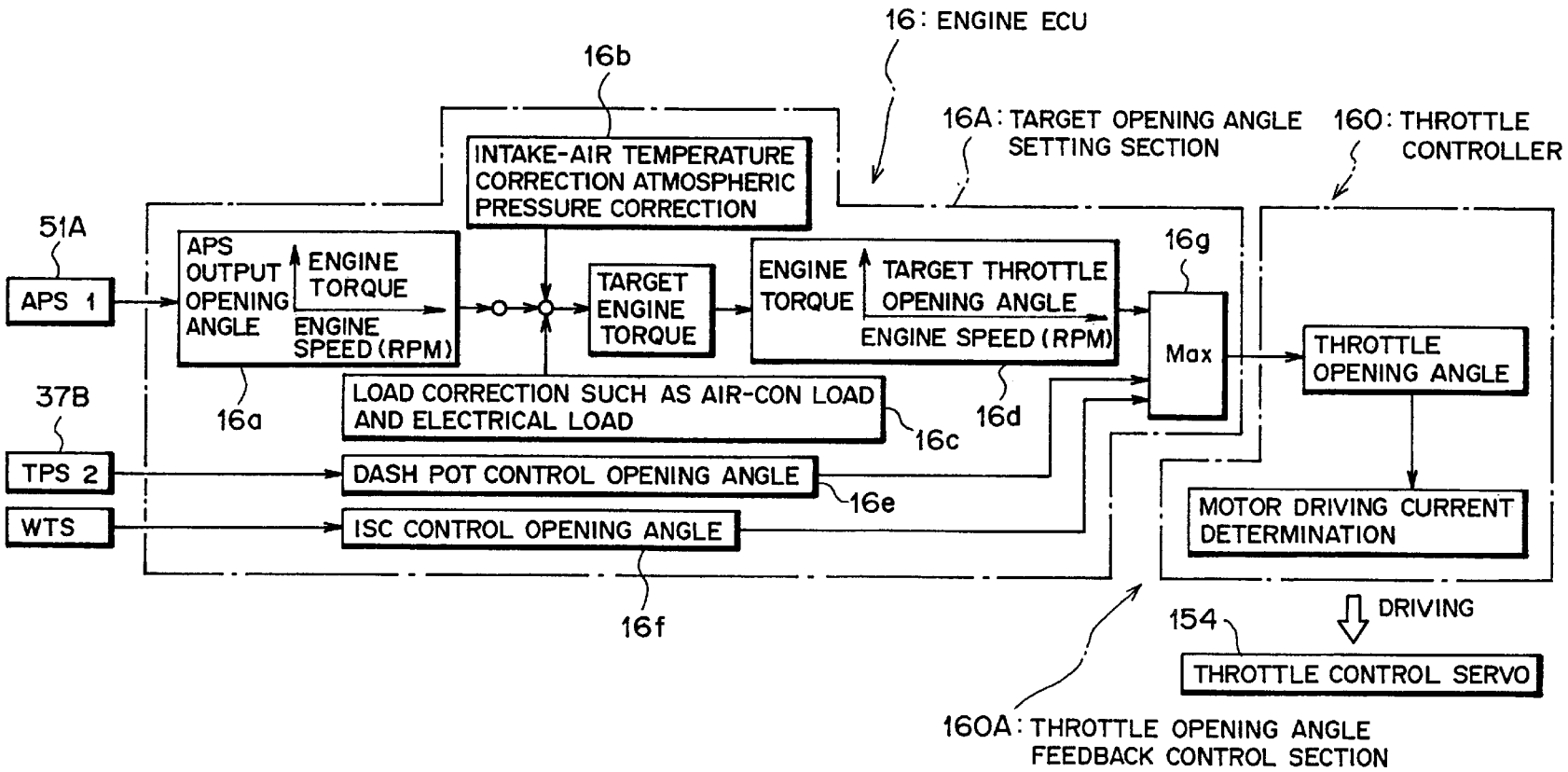
FIG. 3 is a block diagram showing the intake control system of the internal combustion engine according to the embodiment of the present invention.
Figure 4:
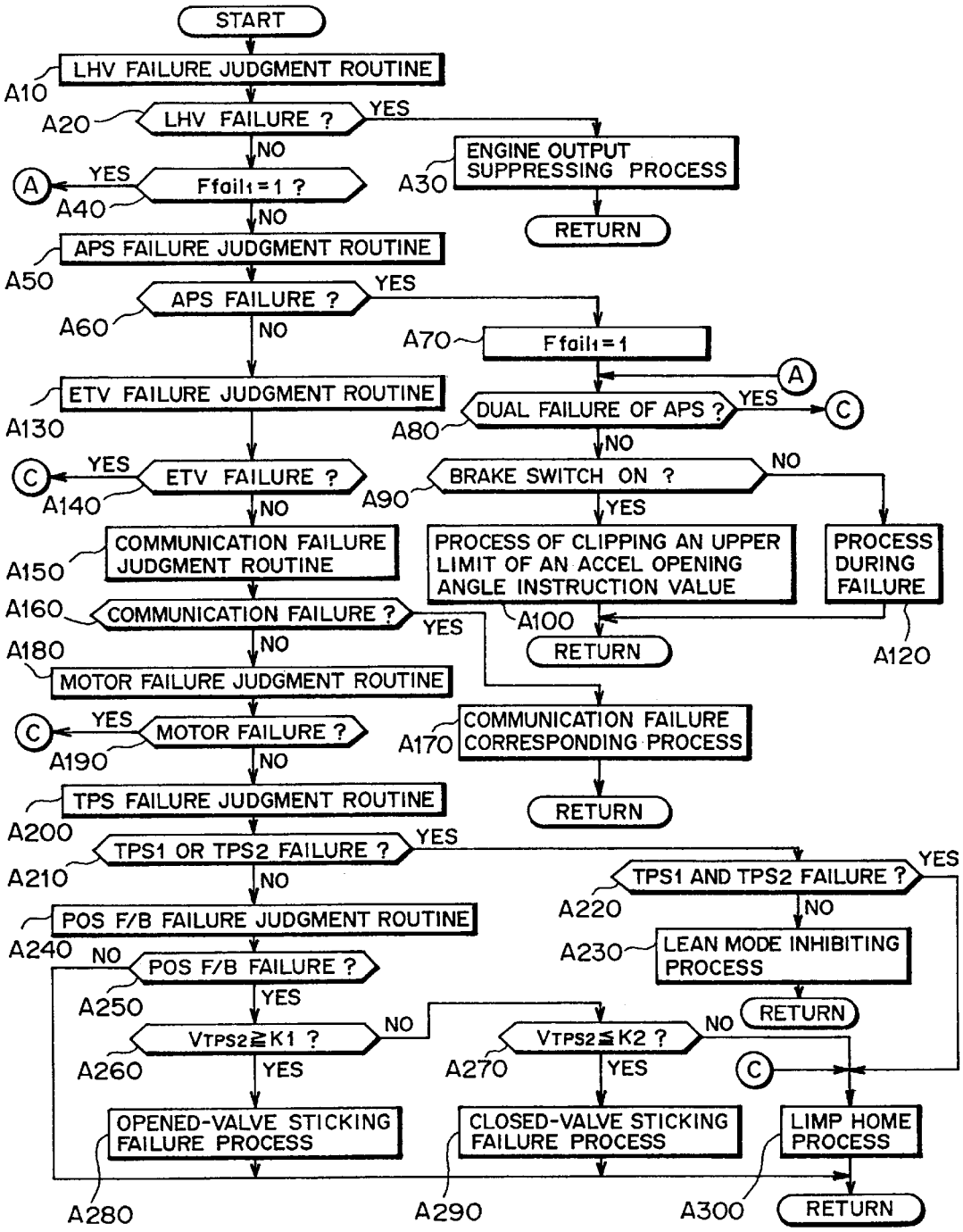
FIG. 4 is a flowchart showing the failure counter plan process of the intake control system of the internal combustion engine according to the embodiment of the present invention.

FIG. 3 shows a control block diagram paying attention to throttle control. As shown in the figure, the target opening angle setting section 16A of the ECU 16 is provided with a first function 16*a* of setting a target engine torque from both the detection information from the first accel position sensor (APS1) 51A and the engine revolution speed obtained from the detection result of the crank angle sensor 41 (see FIG. 2), a second function 16*b* of making an intake-air temperature correction and an atmospheric pressure correction on the set target engine torque, a third function 16*c* of making corrections relevant to the air conditioner and electrical load, and a fourth function 16*d* of setting a target throttle opening angle from the corrected target engine torque and the engine revolution speed.

The target opening angle setting section 16A is further provided with a fifth function 16*e* of setting a dash pot control opening angle on the basis of the detection information from the second throttle position sensor (TPS2) 37B, a sixth function 16*f* of setting an idle speed control opening angle in accordance with the engine cooling water temperature information detected by the water temperature sensor (WTS), and a seventh function 16*g* of selecting the maximum value from among the set opening angles. The target opening angle setting section 16A outputs the selected maximum set opening angle to the throttle controller 160 as the target opening angle of the throttle valve.

The throttle opening angle feedback control section 160A of the throttle controller 160 decides a motor driving current in accordance with the throttle valve target opening angle output from the ECU 16 and controls driving of the actuator (also called a throttle control servo motor) 154. At this time, in the throttle controller 160, the feedback control of the throttle valve is performed according to the opening angle (actual opening angle) of the throttle value detected with the first throttle position sensor (TPS1) 37A.

Incidentally, in this apparatus, as shown in FIG. 1, as with the case of the throttle position sensors (TPS1 and TPS2) 37A and 37B, the accel position sensor 51 also consists of two accel position sensors, a first accel position sensor (APS1) 51A and a second accel position sensor (APS2) 51B. The two accel position sensors are also provided in case of failure.

For this reason, the signal detected by the first accel position sensor (APS1) 51A is input to the ECU 16 and employed in the setting of the throttle valve target opening angle. The signal detected by the second accel position sensor (APS2) 51B is input to the throttle controller 160. If the first accel position sensor 51A fails, the detection signal of the second accel position sensor 51B will be transmitted from the throttle controller 160 to the ECU 16 by communication and employed in the setting of the throttle valve target opening angle.

Similarly, for the throttle position sensor 37, the signal detected by the first throttle position sensor (TPS1) 37A is input to the throttle controller 160 and employed in the feedback control of the throttle valve 15. The signal detected by the second throttle position sensor (TPS2) 37B is input to the EPU 16 and employed in the aforementioned dash pot control. If the first throttle position sensor 37A fails, the detection signal of the second throttle position sensor 37B will be transmitted from the ECU 16 to the throttle controller 160 by communication and employed in the feedback control of the throttle valve.

On the other hand, the limp home valve 12 is constituted by the bypass passage 13 arranged parallel with the intake passage 5A within the throttle body 5 (i.e, between the upstream and downstream sides of the butterfly valve 151 of the electronically controlled throttle valve 15), the LHV main body 14 arranged in the bypass passage 13, a linear solenoid (not shown) for opening and closing the LHV main body 14, and the ECU 16 for controlling operation of the linear solenoid. The control system (limp home valve control unit) 120 is constituted by the linear solenoid and ECU 16.

The limp home valve unit 12 is provided in order to cope with an unlikely failure of the DBW 150. But, in this apparatus, the ECU 16 and the throttle controller 160 perform a variety of failure judgments as a counter plan against such a failure of the DBW 150. For various failure judgments, the respective corresponding processes are performed, for example, with the employment of the limp home valve unit 12.

As shown in FIG. 1, in order to utilize the various failure judgments in the failure corresponding processes, a power source relay 62 is arranged in a power supply circuit from a battery 61 to the throttle controller 160 and is turned on or off by the ECU 16.

Now, a description will be made of the failure judgment processes.

A. Position Feedback Failure

First, a description will be made of the judgment process of the failure (position feedback failure) that the opening angle (position) of the electronically controlled throttle valve 15 cannot be adjusted as instructed.

For the position feedback failure, there is (1) valve system sticking failure (including fully closed sticking) and (2) motor output open failure. When a position feedback failure signal is received, failure is judged.

This failure judgment is performed when all premise conditions for the failure judgment are established. For example, the premise conditions are (1) the ignition switch is on, (2) the relay motor is on, or communication abnormality from the ECU 16 to the throttle controller 160 has occurred, (3) the battery voltage Vb is equal to or greater than a predetermined value, and (4) no communication abnormality from the throttle controller 160 to the ECU 16 has occurred.

One position feedback failure is the sticking of the electronically controlled throttle value 15. In this case the opening angle of the stuck electronically controlled throttle valve 15 can be detected with the first throttle position sensor (TPS1) 37A. Therefore, from this opening angle information, when the throttle valve 15 has been stuck at an opening angle equal to or greater than a first predetermined opening angle (opened-valve sticking), an open sticking corresponding process (opened-valve sticking failure process) is performed, and when the throttle valve 15 has been stuck at an opening angle less than a second predetermined opening angle (closed-valve sticking), a closed sticking corresponding process (closed-valve sticking failure process) is performed.

B. Motor Failure

In failures of the motor, there is (1) a motor ground fault and (2) a motor overcurrent fault (overcurrent detection). When a ground or overcurrent failure signal of the motor output is received, failure is judged. This failure judgment is performed when all premise conditions for the failure judgment are established. The premise conditions are (1) the motor relay is on and (2) no communication abnormality from the throttle controller 160 to the ECU 16 has occurred. When there is motor failure such as this, a limp home mode process to be described later is performed.

C. TPS Failure

The throttle position sensor 37 consists of two sensors, first and second throttle positions sensors 37A and 37B, and for the failure of the first throttle position sensor (TPS1) 37A that is employed in the feedback control by the throttle controller 160, there is (1) failure due to a broken connection or short circuit in the current circuit and (2) a linearity defect. For the failure of the second throttle position sensor (TPS2) 37B, there is (3) characteristic abnormality and (4) failure due to a broken connection or short circuit in the current circuit. When the respective failure signals are received, failure is Judged.

This failure judgment is performed when all premise conditions for the failure judgment are established. The premise conditions are (1) the ignition switch is on and (2) no communication abnormality from the throttle controller 160 to the ECU 16 has occurred.

When the first throttle position sensor (TPS1) 37A has failed, a process of limiting the operating area of the engine is performed, because the failure interferes with the feedback control of the throttle valve. Also, at the time of the failure of the first throttle position sensor (TPS1) 37A, if the second throttle position sensor (TPS2) 37B has already failed or if there is communication abnormality to be described later (communication abnormality from the ECU 16 to the throttle controller 160), a limp home process will be performed.

D. Communication Failure

Communication is performed between the ECU 16 and the throttle controller 160, and in communication failure, there is communication abnormality from the ECU 16 to the throttle controller 160 and communication abnormality from the throttle controller 160 to the ECU 16.

For the communication abnormality from the ECU 16 to the throttle controller 160, when the throttle controller 160 receives a communication failure signal from the ECU 16, failure is judged.

This failure judgment is performed when all premise conditions for the failure judgment are established. The premise conditions are (1) the battery voltage Vb is equal to or greater than a predetermined value and (2) no communication abnormality from the throttle controller 160 to the ECU 16 has occurred.

When this communication failure has occurred, the following processes are performed, because the throttle controller 160 cannot fetch the target opening angle set by the ECU 16 and therefore there is a high possibility that the intake air volume control cannot be appropriately performed.

(1) Lean operation inhibiting process (2) Cruise control inhibiting process (3) Fuel cutting process during the high revolution (e.g., Ne≧3000 rpm) of the engine For the communication abnormality from the throttle controller 160 to the ECU 16, when any of the following conditions is established, failure is judged.

(1) There is a check sum error.

(2) There is an overrun framing error.

(3) There is incomplete communication for a predetermined time (e.g., for 25 msec).

This failure judgment is performed when all premise conditions for the failure judgment are established. The premise conditions are (1) the battery voltage Vb is equal to or greater than a predetermined value and (2) the cruising switch is off.

Likewise, when this communication failure has occurred, the following processes are performed, because the ECU 16 cannot fetch a control signal from the throttle controller 160 and therefore there is a high possibility that the intake air volume control cannot be appropriately performed.

(1) Transmission of communication failure to the throttle controller 160

(2) Lean operation inhibiting process (3) Cruise control inhibiting process (4) Fuel cutting process during the high revolution (e.g., Ne≧3000 rpm) of the engine (5) When the brake pedal is depressed, clip the upper limit of the target opening angle of the throttle valve 15 instructed from the ECU 16.

E. Throttle Controller Failure

For a failure of the throttle controller 160, when all of the following conditions (1) through (4) are established, or when all of the following conditions (5) through (8) are established, failure is judged.

(1) The ignition switch is on.

(2) There is no abnormality in the second accel position sensor (APS2) 51B and the second throttle position sensor (TPS2) 37B.

(3) Communication abnormality from the ECU 16 to the throttle controller 160 has occurred.

(4) $|(V_{APS2})/2-(5\text{ v}-V_{TPS2})|\geqq 1\text{ v}$ (5) The ignition switch is on.

(6) There is no abnormality in the second accel position sensor (APS2) 51B and the second throttle position sensor (TPS2) 37B.

(7) Communication abnormality from the throttle controller 160 to the ECU 16 has occurred.

(8) $|(\text{opening angle voltage instructed from ECU})-V_{TPS2})|\geqq 1\text{ v}$ If a failure of the throttle controller 160 such as this is judged, a limp home process will be performed.

F. APS Failure

The accel position sensor 51 consists of two sensors, first and second accel positions sensors (APS1 and APS2) 51A and 51B, and for the failures of these first and second accel position sensors (APS1 and APS2) 51A and 51B, there is (1) failure due to a short circuit in the current circuit and failure due to a broken connection between the sensor and ground, (2) failure due to a broken connection in the current circuit and failure due to a short circuit between the sensor and ground, and (3) characteristic abnormality.

For the second accel position sensor (APS2) 51B, the failure due to a short circuit in the current circuit and failure due to a broken connection between the sensor and ground are judged when both of the following conditions are established, on the premise that (1) there is no communication abnormality and also (2) there is no abnormality in the first accel position sensor (APS1) 51A.

(1) The output value $V_{APS2}$ of the second accel position sensor 51B is equal to or greater than a predetermined value V1 (e.g., if V1=4.5 v, $V_{APS2} \geqq 4.5$ v).

(2) The output value $V_{APS1}$ of the first accel position sensor 51A is in a predetermined area (e.g., 0.2 v$\leqq V_{APS1} \leqq$2.5 v).

For the second accel position sensor (APS2) 51B, the failure due to a broken connection in the current circuit and failure due to a short circuit between the sensor and ground are judged when the output value $V_{APS2}$ of the second accel position sensor 51B is less than a predetermined value V2 (e.g., if V2=0.2 v, $V_{APS2}$<0.2 v).

For the first accel position sensor (APS1) 51A, the failure due to a short circuit in the current circuit and failure due to a broken connection between the sensor and ground are judged when both of the following conditions are established, on the premise that (1) there is no communication abnormality and also (2) there is no abnormality in the second accel position sensor (APS2) 51B.

(1) The output value $V_{APS1}$ of the first accel position sensor 51A is equal to or greater than a predetermined value V3 (e.g., if V2=4.5 v, $V_{APS1} \geqq 4.5$ v).

(2) The output value $V_{APS2}$ of the second accel position sensor 51B is in a predetermined area (e.g., 0.2 v$\leqq V_{APS2} \leqq$2.5 v).

For the first accel position sensor (APS1) 51A, the failure due to a broken connection in the current circuit and failure due to a short circuit between the sensor and ground are judged when the output value $V_{APS1}$ of the first accel position sensor 51B is less than a predetermined value V4 (e.g., if V4=0.2 v, $V_{APS1}$<0.2 v).

In addition, the characteristic abnormality in the accel position sensor is judged when $V_{APS2} \geqq 1.1$ v, on the premise that the idle switch is on (i.e., during idle running).

When the second accel position sensor 51B has failed, the following processes are performed.

(1) Setting of $V_{APS}=V_{APS1}/2$ (2) Lean operation inhibiting process (3) Cruise control inhibiting process (4) Process of clipping the upper limit of engine output However, after the failure detection of the second accel position sensor (APS2) 51B, when communication abnormality from the throttle controller 160 to the ECU 16 has occurred, the limp home process is performed.

Also, when the first accel position sensor 51A has failed, the following processes are performed.

(1) Setting of $V_{APS}=V_{APS2}/2$ (2) Lean operation inhibiting process (3) Cruise control inhibiting process (4) Process of clipping the upper limit of engine output However, if the second accel position sensor (APS2) 51B has already failed, the limp home process will be performed.

When the characteristic abnormality in the accel position sensor has occurred, the following processes are performed.

(1) Setting of $V_{APS}=V_{APS1}/2$ (2) Lean operation inhibiting process (3) Cruise control inhibiting process (4) Process of clipping the upper limit of engine output However, if the first accel position sensor (APS1) 51A has already failed, the limp home process will be performed.

G. LHV Failure

The failure judgment of the LHV 12 is performed when (1) the LHV solenoid is off and also (2) the terminal voltage Lo is detected.

When this LHV 12 has failed, the following processes are performed.

(1) A forced compression lean operation is set.

(2) Fuel cutting process during the high revolution (e.g. Ne$\geqq$3000 rpm) of the engine (3) Cut EGR.

(4) Inhibit the engine speed feedback control of idle speed control

The limp home process, incidentally, is performed as follows:

A: Fuel cut process

1) During forward travel (1) When the output value of the second accel position sensor (APS2) 51B is less than a predetermined value ((5 v−$V_{APS2}$)>1.5 v), fuel is injected into all cylinders.

(2) When the output value of the second accel position sensor (APS2) 51B is equal to or greater than the predetermined value ((5 v−$V_{APS2}$)$\leqq$1.5 v), injection of fuel into some of the cylinders (e.g., 3 cylinders if there are a total of 6 cylinders) is cut.

(3) When the second accel position sensor (APS2) 51B has failed, injection of fuel into some of the cylinders (e.g., 3 cylinders if there are a total of 6 cylinders) is cut.

(4) When the accel pedal is depressed, injection of fuel into some of the cylinders (e.g., 3 cylinders if there are a total of 6 cylinders) is cut.

2) During reverse travel Injection of fuel into some of the cylinders (e.g., 3 cylinders if there are a total of 6 cylinders) is cut.

B: The motor relay is turned off.

C: The LHV 12 is turned on (however, when the brake pedal is depressed (when the brake switch 200 is on), the duty control of the LHV 12 is performed at 5 Hz for a predetermined time (e.g., 2 sec)).

D: A lean operation is inhibited.

E: Cruise control is inhibited.

F: The feedback control of the engine revolution speed is inhibited.

G: The warning lamp is lit.

H: Once a transition to the limp home mode is made, a return to normal operation will not be made until the ignition switch is turned off.

Now, attention will be paid to the feature parts of the present invention and a description thereof will be described.

As described above, the drive-by-wire (DBW) 150 is provided with two accel position sensors (accel opening angle detection means) 51A and 51B and two throttle position sensors (throttle opening angle detection means) 37A and 37B in case the DBW 150 fails. This allows two sets of electronic throttle control systems 231 and 232 to be constituted (see FIG. 6).

The first electronic throttle control system (hereinafter referred to as a first control system) 231 is constituted by the first accel position sensor (APS1) 51A, the first throttle position sensor (TPS1) 37A, and the electric motor (throttle actuator) 154. The second electronic throttle control system (hereinafter referred to as a second control system) 232 is constituted by the second accel position sensor (APS2) 51B, the second throttle position sensor (TPS2) 37B, and the electric motor (throttle actuator) 154. In this embodiment, while the first and second control systems 231 and 232 employ the common motor 154, they may be provided with different motors respectively.

As previously described, usually the throttle control 160 sets the opening angle of the throttle value on the basis of the accel opening angle information from the first accel position sensor (APS1) 51A, and based on the control signal from the throttle controller 160, the electric motor 154 is driven so that the opening angle of the butterfly valve 151 reaches the set opening angle. In addition, the opening angle of the butterfly valve 151 is fed back to the feedback control section 160A of the throttle controller 160 by the first throttle position sensor (TPS1) 37A.

Figure 6:
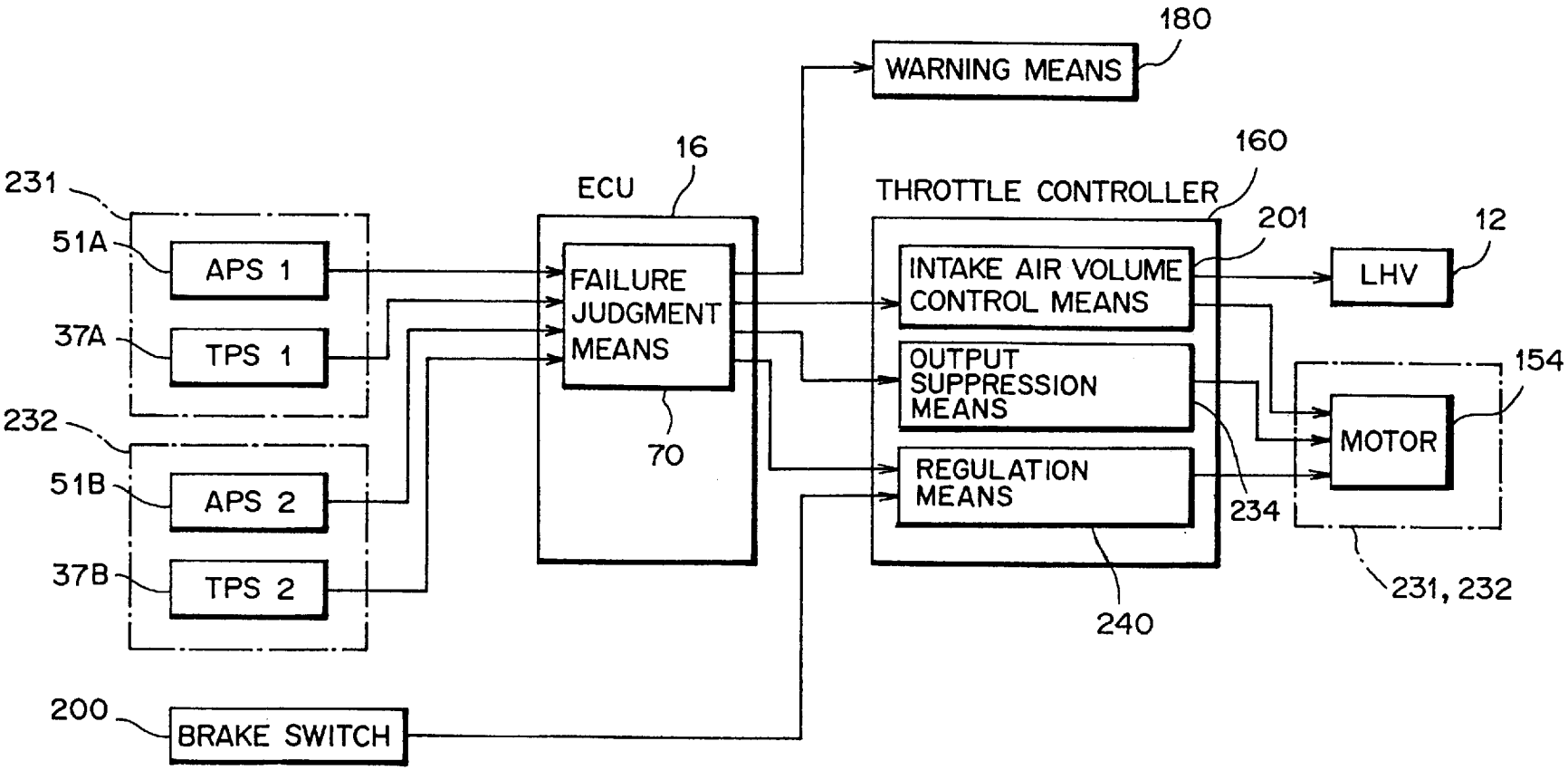
FIG. 6 is a schematic block diagram giving attention to the essential functions of the control apparatus for an internal combustion engine according to the embodiment of the present invention.

On the other hand, as shown in FIGS. 1 and 6, the ECU 16 and the throttle controller 160 are provided with failure judgment means 70, which in turn judge failures of the sensors and the motor 154.

In the first control system 231, if it is judged that the first accel position sensor (APS1) 51A or the first throttle position sensor (TPS1) 37A has failed, the DBW 150 will be controlled by the second control system 232.

Thus, the control system of the DBW 150 is duplexed. Consequently, even if one control system 231 fails, the DBW 150 can be controlled by the other control system 232, whereby the fail safe system is obtainable.

In addition, when a failure of the first control system 231 is judged, warning means 180 is operated by the ECU 16. This warning means 180 is, for example, a warning lamp provided in the instrument panel of a vehicle. If this warning lamp is lit, the driver can be informed that failure has occurred in the first control system 231, thereby urging the driver to an early repair.

Incidentally, even when such a failure of the first control system 231 has occurred, it is also considered that the driver will continue to travel as he is, without noticing a warning such as the aforementioned. In addition, even if the driver is aware of a warning such as this, it will be considered that the driver will continue to travel as he is, because in the DBW 150 equipped with a duplex control system such as the aforementioned, the DBW 150 is controlled by the other control system 232 and has no adverse effect on the traveling performance.

However, if the driver continues to travel with one control system 231 failed and, thereafter, the other control system 232 fails, then usual traveling will be difficult. In this case, since the aforementioned limp home process is carried out, the minimum traveling ability is ensured, but usual traveling becomes difficult.

Hence, in the control apparatus for an internal combustion engine of the present invention, when a failure of the accel position sensor (APS1) 51A of the first control system 231 has been judged, the opening angle of the throttle valve 15 relative to the stepping-on quantity of the accel pedal of the driver is purposely suppressed.

That is, as shown in FIG. 1, the throttle controller 160 is provided with output suppression means 234. If a failure of the accel position sensor (APS1) 51A is judged by the failure judgment means 70, the output suppression means 234 will reduce an actual valve opening angle in comparison with the opening angle of the throttle valve 15 which is set in correspondence with the stepping-on quantity of the accel pedal of the driver and will also cause the driver to recognize the failure of the first control system 231.

Now, a description will be made of the suppression control of the engine output which is performed by the output suppression means 234. If a failure of the first control system 231 is judged, ½ of the output value $V_{APS2}$ of the accel opening angle which is obtained by the second accel position sensor (APS2) 51B will be set as an accel opening angle. That is, in the throttle controller 160, if $V_{APS}=V_{APS2}/2$ is set, the opening angle of the throttle valve 15 based on the opening angle of the accel pedal will be set to half the usual opening angle.

If such output suppression means 234 is provided, the engine output relative to the driver's request is suppressed when the first control system 231 has failed and therefore the driver will feel an abnormality in the handling of the vehicle, whereby it will be possible to cause the drive to recognize with reliability the failure of the first control system 231.

In addition, even in the case where the driver continues to travel while recognizing the failure of the first control system 231 by the operation of the warning means 180, it is possible to cause the driver to recognize the necessity of repair, because the output of the engine is suppressed.

Note that similar control as the aforementioned is also performed in the case where it is judged that the first control system 231 is normal and the second control system 232 abnormal. That is, in this case, $V_{APS}=V_{APS1}/2$ is set and the output of the engine is also suppressed.

On the other hand, it is also considered that all of the aforementioned duplex control systems 231 and 232 fail. In such a case the aforementioned limp home process is executed. That is, if failures of both control systems 231 and 232 are judged by the failure judgment means 70, the intake air volume control means 201 provided in the throttle controller 160 will turn the motor relay off so that power to the electric motor 154 is shut off and will also turn the LHV 12 on.

In this case, if power to the electric motor 154 is turned off, the valve body (butterfly valve) 151 of the throttle valve 15 will be closed by the urging force of the return spring 153 and the throttle valve 15 will be caused to be in a nearly fully closed state. In addition, if the LHV 12 is turned on, the bypass passage 13 will be opened and intake air taken into the intake passage 2 will pass through the bypass passage 13 within the throttle body 5, whereby a certain volume of intake air will be supplied to the engine 1.

Therefore, even if both control systems 231 and 232 should fail, the vehicle will not stall and can travel by itself to a service station and the like, because the minimum intake air volume necessary for a vehicle to travel is ensured. The minimum intake air volume necessary for a vehicle to travel is, for example, an intake air volume such that a vehicle can travel at a speed of about 80 km/h.

In the aforementioned, although it has been described that two sets of control systems 231 and 232 are provided as the electronic throttle control system, it may be constituted by three or more sets of control systems.

In addition, if the output suppression means 234 is provided, the output of the engine relative to the driver's request is suppressed and also the engine output is reduced when the brake pedal is depressed. Consequently, the driver feels an abnormality in the handling of the vehicle, whereby it is possible to cause the driver to recognize with reliability the failure of the first control system 231.

Incidentally, although both control systems 231 and 232 have failed (such failures will hereinafter be referred to as dual failure), the case where dual failure cannot be judged by the failure judgment means 70 is considered.

Particularly, in this embodiment, since failures of the accel position sensors 51A and 51B are judged on the basis of a difference in detection information between these sensors 51A and 51B, there are cases where judgment of dual failure becomes difficult in the following case. That is, specifically, in the failure judgment means 70, basically if the difference between the output value $V_{APS1}$ from the accel position sensor (APS1) 51A and the output value $V_{APS2}$ from the accel position sensor (APS2) 51B is within a predetermined value, it will be judged that the accel position sensors 51A and 51B are operating normally, so a failure of one sensor can be judged. However, in the case where the other sensor has failed at the same position, the case where dual failure is not judged is considered.

In addition, in the case where both accel position sensors 51A and 51B have failed, when such dual failure is not judged, the aforementioned limp home process mode is not executed and motion of the throttle valve 15 is unpredictable. Therefore, from such an aspect there is also a need to take some counter plan before dual failure takes place.

Hence, in the control apparatus for an internal combustion engine of the present invention, when a failure of one accel position sensor (here, the first accel position 51A is employed as representation) is judged by the failure judgment means 70, if the driver steps on the brake pedal, the driver will be regarded as having an intention to reduce speed or stop traveling, and the opening angle of the throttle valve 15 will be clipped at a predetermined opening angle.

That is, as shown in FIG. 6, the throttle controller 160 is provided with regulation means 240 for regulating an opening angle of the throttle valve. If a failure of one accel position sensor 51A is judged by the information from the failure judgment means 70 and also it is detected by the information from a brake switch 200 that the driver has stepped on the brake pedal, then the opening angle of the throttle valve 15 will be clipped at a predetermined upper limit value by the regulation means 240. Consequently, in such a case, the output of the engine can be suppressed with reliability and the vehicle can be decelerated or stopped with reliability.

Incidentally, in this case the process of clipping an opening angle of the throttle valve 15 at the upper limit value is performed by clipping the upper limit value of a target opening angle voltage instructed to the electric motor (throttle actuator) 154. In other words, if a failure of one accel position sensor 51A is judged and also the stepping-on of the brake pedal is detected, the throttle controller 160 will set, for example, the instructed target opening angle voltage to 0.8 V with respect to the motor 154, and the opening angle of the throttle valve corresponding to this voltage will be clipped as the upper limit value of the opening angle.

Thus, in the control apparatus for an internal combustion engine of the present invention, if a failure of either of the accel position sensors 51A and 51B is judged, the upper limit value of the opening angle of the throttle valve will be clipped on the basis of the operation of the brake pedal as a counter plan in the case where dual failure of the accel position sensors 51A and 51B is not judged. Therefore, thereafter, even in the case where the other accel position sensor 51A or 51B fails but this failure is not judged, an unpredictable operation of the throttle valve 15 can be prevented and vehicle safety can be enhanced.

In addition to the clipping of the upper limit value of the opening angle of the throttle valve, in the case where a failure of either of the accel position sensors 51A or 51B is judged, the following processes are carried out as described in the aforementioned item of "F. APS failure."

(1) Setting of $V_{APS}=V_{APS2}/2$ or setting of $V_{APS}=V_{APS1}/2$ (2) Lean operation inhibiting process (3) Cruise control inhibiting process Since the control apparatus for an internal combustion engine as an embodiment of the present invention is constituted as described above, the process shown in FIG. 4, for example, will be carried out if the intake control system, i.e., the electronic throttle control unit (DBW) 150 and the LHV 12 fail.

First, the process relevant to the judgment of LHV failure is performed by an LHV failure judgment routine (step A10). In the judgment of LHV failure, it is judged (1) whether or not the LHV solenoid is off and (2) whether or not the terminal voltage Lo has been detected. If (1) the LHV solenoid is off and also (2) the terminal voltage Lo has been detected, LHV failure will be judged. In this case, in step A30 via judgment of step A20, an engine output suppressing process is performed. Specifically, the following processes are performed.

(1) The operating mode is forcibly set to the late lean combustion mode (compression stroke injection mode), thereby suppressing the output of the engine.

(2) If the engine revolution speed Ne reaches a predetermined revolution speed (e.g., 3000 rpm) or greater, fuel supply will be cut, thereby suppressing the engine output.

(3) EGR is cut, thereby causing stable combustion to have priority over exhaust gas purification.

(4) For the idle speed control, the feedback control of the engine revolution speed is inhibited, thereby giving priority to stable combustion.

On the other hand, if there is no failure of the LHV 12, the process will advance to step A40 via the judgment of step A20. In step A40 it is judged whether or not an APS fail flag $F_{fail1}$ is 1. This APS fail flag $F_{fail1}$ will be 1 if either of the accel position sensors (APS) 51A and 51B fails, and will be 0 if not so. If the APS fail flag $F_{fail1}$ is 1, the process will advance to a dual failure judgment routine of step A80. If the APS fail flag $F_{fail1}$ is not 1, the process will advance to an APS failure judgment routine of step A50.

In the APS failure judgment routine of step A50, for the first accel position sensor (APS1) 51A and the second accel position sensor (APS2) 51B, a judgment process such as the aforementioned is performed with regard to (1) failure due to a short circuit in the current circuit and failure due to a broken connection between the sensor and ground, (2) failure due to a broken connection in the current circuit and failure due to a short circuit between the sensor and ground, and (3) characteristic abnormality.

If APS failure is judged, the process will advance to step A80 via step A70. In step A80 it is judged whether or not both the first and second accel position sensors (APS1 and APS2) 51A and 51B have failed. If dual failure of the accel positions sensors has occurred, the process will advance to step A300 and the limp home process will be performed. If no dual failure has occurred, i.e., if only either of the two accel position sensors has occurred, the process will advance to step A90.

In step A90 it is judged whether or not the brake switch 200 is on, i.e., whether or not the braking operation has been performed. If the braking operation has been performed, the process will advance to step A100 and a throttle opening angle instruction value will be clipped at the upper limit value to suppress the intake air volume, thereby suppressing the output of the engine. If no braking operation has been performed, the process will advance to step A120 and each failure process will be performed according to APS failure.

In other words, when the second accel position sensor 51B has failed, (1) setting of $V_{APS}=V_{APS1}/2$, (2) lean operation inhibiting process, (3) cruise control inhibiting process, and (4) process of clipping the upper limit of engine output are performed. However, after the failure detection of the second accel position sensor (APS2) 51B, when communication abnormality from the throttle controller 160 to the ECU 16 has occurred, the limp home process is performed.

When the first accel position sensor 51A has failed, (1) setting of $V_{APS}=V_{APS2}/2$, (2) lean operation inhibiting process, (3) cruise control inhibiting process, and (4) process of clipping the upper limit of engine output are processed. However, if the second accel position sensor (APS2) 51B has already failed, the limp home process will be performed.

In addition, when the characteristic abnormality in the accel position sensor has occurred, (1) setting of $V_{APS}=V_{APS1}/2$, (2) lean operation inhibiting process, (3) cruise control inhibiting process, and (4) process of clipping the upper limit of engine output are performed. However, if the first accel position sensor (APS1) 51A has already failed, the limp home process will be performed.

On the other hand, if there is no APS failure, the process will advance from step A60 to an ETV judgment routine of step A130.

In this ETV judgment routine, a failure of the throttle controller is judged. The throttle controller is judged to have failed when (1) the ignition switch is on, (2) there is no abnormality in the second accel position sensor (APS2) and the second throttle position sensor (TPS2), (3) communication abnormality from the ECU 16 to the throttle controller 160 has occurred, and (4) $|(V_{APS2})/2-(5\text{ v}-V_{TPS2})|\geqq 1$ v, or when (5) the ignition switch is on, (6) there is no abnormality in the second accel position sensor (APS2) and the second throttle position sensor (TPS2), (7) communication abnormality from the throttle controller 160 to the ECU 16 has occurred, and (8) $|(\text{opening angle voltage instructed from ECU})-V_{TPS2})|\geqq 1$ v.

If the failure of the throttle controller is judged, the process will advance to step A300 via step A140 and the limp home process will be performed. If no failure of the throttle controller is judged, the process will advance to a communication failure judgment routine of step A150.

In this communication failure judgment routine, communication abnormality from the ECU 16 to the throttle controller 160 and communication abnormality from the throttle controller 160 to the ECU 16 are judged.

For the communication abnormality from the ECU 16 to the throttle controller 160, the abnormality judgment is made under the condition (zone) where (1) the battery voltage Vb is equal to or greater than a predetermined value and (2) no communication abnormality from the throttle controller 160 to the ECU 16 has occurred. When the throttle controller 160 receives a communication failure signal from the ECU 16, failure is judged.

For the communication abnormality from the throttle controller 160 to the ECU 16, the abnormality judgment is made under the condition (zone) where (1) the battery voltage Vb is equal to or greater than a predetermined value and (2) the cruising switch is off. When (1) there is a check sum error, (2) there is an overrun framing error, and (3) there is incomplete communication for a predetermined time (e.g., for 25 msec), failure is judged.

If such communication failure is judged, the process will advance to step A170 via step A160 and the communication failure corresponding process will be performed.

In other words, when the communication abnormality from the ECU 16 to the throttle controller 160 has occurred, there is a high possibility that the intake air volume control cannot be appropriately performed. Therefore, (1) the lean operation is inhibited, (2) the cruise control is inhibited, and (3) at the time of the high revolution (e.g., $Ne\geqq 3000$ rpm) of the engine, fuel cut is performed.

Similarly, when the communication abnormality from the throttle controller 160 to the ECU 16 has occurred, there is a high possibility that the intake air volume control cannot be appropriately performed. Therefore, (1) communication failure is transmitted to the throttle controller 160, (2) the lean operation is inhibited, (3) the cruise control is inhibited, (4) at the time of the high revolution (e.g., $Ne\geqq 3000$ rpm) of the engine, fuel cut is performed, and (5) when the brake pedal is depressed, the upper limit of the target opening angle of the throttle valve 15 instructed from the ECU 16 is clipped.

If no communication failure is judged, the process will advance to a motor failure judgment routine of step A180 via step A160.

In the motor failure judgment routine, when a ground or overcurrent failure signal of the motor output is received, motor failure is judged. This motor failure judgment is performed under the condition (zone) where (1) the motor relay is on and (2) no communication abnormality from the throttle controller 160 to the ECU 16 has occurred.

If this motor failure is judged, the process will advance to step A300 via step A190 and the limp home process will be performed. If no motor failure is judged, the process will advance to a TPS failure judgment routine of step A200.

In the TPS failure judgment routine, the failure judgment is performed under the condition (zone) where (1) the ignition switch is on and (2) no communication abnormality from the throttle controller 160 to the ECU 16 has occurred. When the respective failure signals are received, failure is judged. For the failure of the first throttle position sensor (TPS1) 37A that is employed in the feedback control by the throttle controller 160, there is (1) failure due to a broken connection or short circuit in the current circuit and (2) a linearity defect. For the failure of the second throttle position sensor (TPS2) 37B, there is (3) characteristic abnormality and (4) failure due to a broken connection or short circuit in the current circuit.

Based on the judgment result of such a TPS failure judgment routine, in step A210 it is judged whether or not either of the TPS1 and TPS2 has failed. If either of the TPS1 and TPS2 has failed, the process will advance to step A220 and it will be judged whether or not both of the TPS1 and TPS2 have failed.

If both of the TPS1 and TPS2 have failed, the process will advance to step A300 and the limp home process will be performed. If not so (i.e., if only either of the TPS1 and TPS2 has failed), the process will advance to step A230 and the lean mode inhibiting process will be performed. The lean mode is established on the basis of high precise throttle control, so when TPS failure has occurred, there is a fear that in the lean mode, stable combustion will be degraded. To avoid the fear, the lean mode is inhibited.

On the other hand, if neither of the throttle position sensors has failed, the process will advance to a position feedback failure judgment routine (POS F/B failure judgment routine) of step A240 via step A210.

In the position feedback failure judgment routine, position feedback failures, i.e., (1) valve system sticking failure (including fully closed sticking) and (2) motor output open failure are judged. This judgment is performed under the condition (zone) where (1) the ignition switch is on, (2) the relay motor is on, or communication abnormality from the ECU 16 to the throttle controller 160 has occurred, (3) the battery voltage Vb is equal to or greater than a predetermined value, and (4) no communication abnormality from the throttle controller 160 to the ECU 16 has occurred. When a position feedback failure signal is received, failure is judged.

If no position feedback failure is judged, the process will return via step A250 and the failure process will not be performed. If position feedback failure is judged, the process will advance to step A260 via step A250 and it will be judged whether or not a second throttle valve opening angle $V_{TPS2}$ is equal to or greater than a predetermined value K1 (K1: a value near the fully opened valve). If the second throttle valve opening angle $V_{TPS2}$ is equal to or greater than the predetermined value K1, the process will advance to step A280 and the opened-valve sticking failure process will be performed.

In step A260, if the second throttle valve opening angle $V_{TPS2}$ is not equal to or greater than the predetermined value K1, the process will advance to step A270 and it will be judged whether or not the second throttle valve opening angle $V_{TPS2}$ is less than a predetermined value K2 (K2: a value near the fully closed valve). If the second throttle valve opening angle $V_{TPS2}$ is less than the predetermined value K2, the process will advance to step A290 and the closed-valve sticking failure process will be performed.

If the second throttle valve opening angle $V_{TPS2}$ is a value between the predetermined values K1 and K2, the process will advance to step A300 and the limp home process will be performed.

Figure 5:
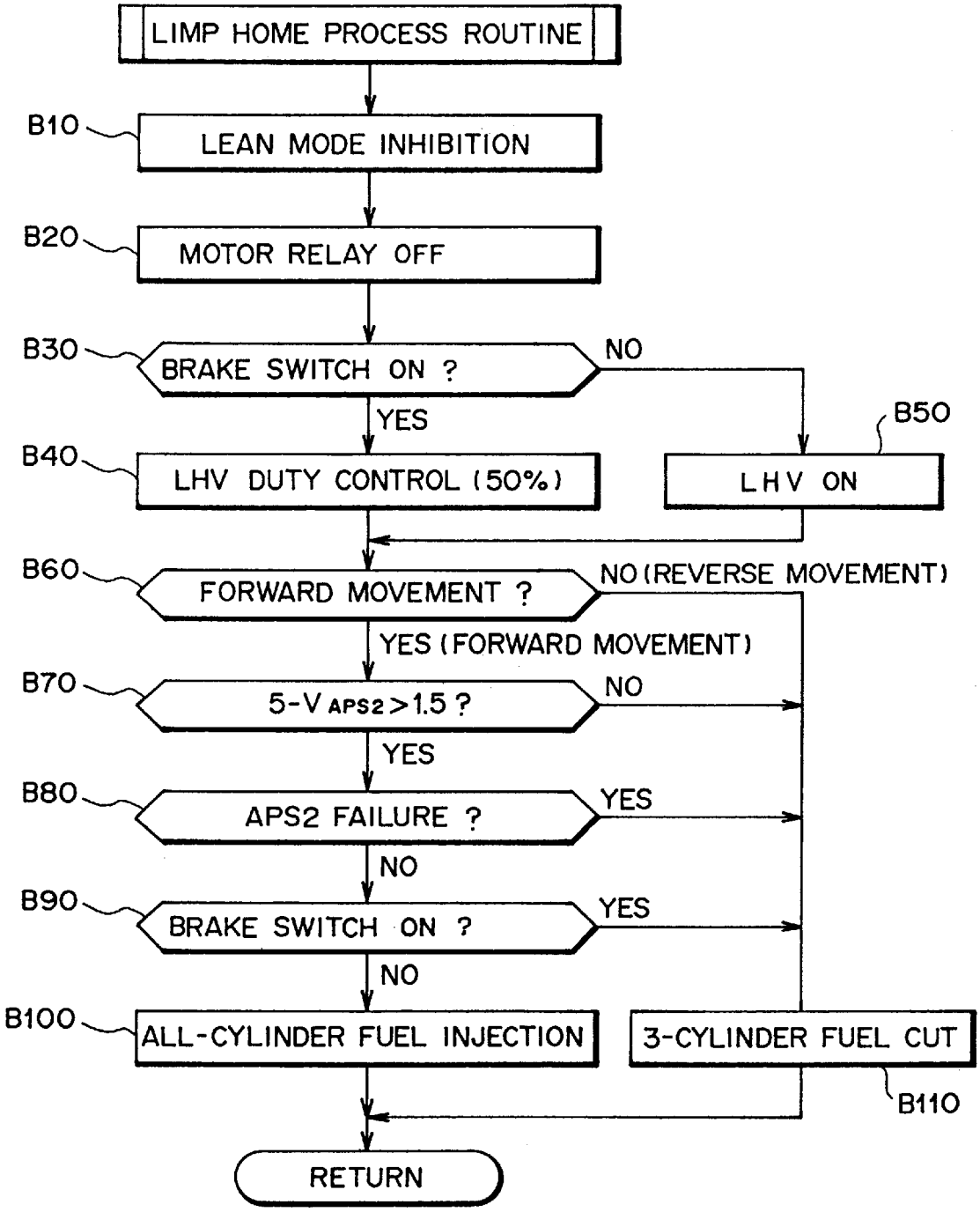
FIG. 5 is a flowchart showing a limp home process in the failure counter plan process of the intake control system of the internal combustion engine according to the embodiment of the present invention.

Next, if a description will be made of the operation during the limp home process which is the feature of the control apparatus for an internal combustion engine according to this embodiment, this limp home process of step A300 will be performed as shown in FIG. 5.

During the limp home process, the lean operating mode is first inhibited (step B10). In other words, the lean operating mode requiring high precision throttle control is avoided, thereby performing stable combustion in a stoichiometric mode.

Next, the motor relay (power supply relay) 62 is turned off (step B20). With this, power will not be supplied to the throttle controller 160, and the throttle valve control through the throttle controller 160 will not be performed. Consequently, an intake air volume is regulated only by controlling the limp home valve 12.

Then, it is judged whether or not the brake switch 200 is on, i.e., whether or not the braking operation has been performed (step B30). If the brake switch 200 is on, the duty control of the limp home valve (LHV) 12 will be performed by a predetermined time (e.g., 2 sec) (step B40).

In other words, this limp home valve 12 is an ON-OFF valve which is normally set to either an ON state or an OFF state and also is an electromagnetic valve, so duty control is also possible. In this embodiment, the volume of air flowing through the bypass passage 13 is reduced by suppressing the opening angle of the LHV 12 at a duty ratio of about 50%, for example. This ensures negative pressure in a master vac (not shown) which increases negative pressure in the intake manifold 9. Therefore, even if the drive by wire 150 fails and the limp home process is performed, braking force equivalent to usual braking force can be ensured, because sufficient negative pressure in the master vac is ensured during a braking operation.

Such duty control will be sufficient if it is performed for a predetermined time (here, 2 sec) after the start of the braking operation, so the duty control is completed after the predetermined time. Note that if the duty control of the limp home valve 12 is regulated to within a predetermined time, durability of the solenoid will also be ensured.

On the other hand, if the brake switch 200 is off, the LHV 12 will be caused to be in an ON (open) state (step B50).

After steps B40 and B50 have been performed, the process advances to step B60 and it is judged whether or not the vehicle is moving forward.

If the vehicle is not moving forward, it means the vehicle is moving in reverse and therefore the fuel cut to some cylinders (e.g., 3 cylinders of 6 cylinders) will be performed, thereby suppressing engine output (step B110). If the vehicle is moving forward, the process will advance to step B70 and it will be judged whether or not the output value of the second accel position sensor (APS2) 51B is equal to or greater than a predetermined value ((5 v $V_{APS2}$)>1.5 v or (5 v−$V_{APS2}$)≦1.5 v).

When (5 v−$V_{APS2}$)≦1.5 v, the process advances to step B110 and the fuel cut to some cylinders (e.g., 3 cylinders of 6 cylinders) is performed, thereby suppressing engine output. Also, if (5 v−$V_{APS2}$)>1.5 v, the process will advance to step B80 and it will be judged whether or not the second accel position sensor (APS2) 51B has failed. This failure judgment is performed as described above.

If the APS2 has failed, the process will advance to step B110 and the fuel cut to some cylinders (e.g., 3 cylinders of 6 cylinders) will be performed, thereby suppressing engine output. If the APS2 has not failed, the process will advance to step B90 and it will be judged whether or not the brake switch 200 is on, i.e., whether the braking operation has been performed.

If the brake switch 200 is on, the fuel cut to some cylinders (e.g., 3 cylinders of 6 cylinders) will be performed, thereby suppressing engine output. If the brake switch 200 is not on, the process will advance to step B100, fuel will be injection into all cylinders, thereby ensuring output.

In addition, during the limp home process, the warning lamp 180 is also lit.

Thus, the limp home process is performed when the vehicle is moving forward and also in the case where there is no failure of the APS2 (i.e., a driver's intention to request speed can be grasped from APS2 information) and the accel opening angle is equal to or greater than a predetermined value without a braking operation. That is, when the driver is requesting engine output, fuel cut is not performed, but, during reverse travel, during APS2 failure, during a breaking operation, or when the accel opening angle is less than a predetermined value, the fuel cut to some cylinders (e.g., 3 cylinders of 6 cylinders) is performed as safety control, thereby suppressing engine output.

Therefore, the driver can obtain the speed of the vehicle if the braking operation is not being performed, and can also perform speed reduction or stopping if the braking operation is being performed. In addition, during a failure of the intake system, vehicle speed control reflecting a driver's intention can be performed at a certain level on the basis of braking operation information which is the remaining driver's intention reflection means.

Incidentally, as described in the aforementioned step A120, for the operation which is the feature of the control apparatus for an internal combustion engine of the present invention, in this apparatus if the failure of either one or the other of two accel position sensors 51A and 51B (e.g., first accel position sensor 51A) is detected, the accel opening angle output value $V_{APS2}$ obtained by the other normal accel position sensor (e.g., second accel position sensor 51B) will be set to ½. Thus, if $V_{APS}=V_{APS2}/2$ is set, the opening angle of the throttle valve 15 based on the accel opening angle will be set to half the usual opening angle.

With this, during a failure of one control system (specifically, during a failure of the first accel position sensor 51A), the intake air volume is reduced by half, thereby suppressing the engine output requested by the driver. Therefore, the driver will feel an abnormality in the handing of the vehicle and recognize that something abnormal has occurred in the vehicle.

Also, since the output of the engine is suppressed, it is considered that the driver will view the instrument panel. In this case, even if the driver has not yet noticed the lighting of the warning lamp 180, the driver will notice the lighting of the warning lamp 180 by viewing the instrument panel, whereby it will be possible to cause the driver to recognize the failure of the control system 231.

In addition, even in the case where the driver continues to travel while recognizing the failure of the first control system 231 by the operation of the warning means 180, it is possible to cause the driver to recognize with reliability the necessity of repair, because engine output is suppressed.

Note that while failures of the accel position sensors 51A and 51B have been described as failures of the first and second control systems 231 and 232, the present invention is not limited only to the case of the failures of the accel position sensors 51A and 51B. The present invention is also applicable to the case where failures of other sensors constituting the control systems 231 and 232 are judged. Thus, since the apparatus of the present invention is applicable to sensors other than the accel position sensors 51A and 51B, it can provide an electronic throttle control apparatus which is even higher in safety and reliability.

On the other hand, as described in the aforementioned steps A80, A90, and A100, in step A80 if it is not judged that dual failure, i.e., both of the first and second accel position sensors (APS1 and APS2) 51A and 51B have failed but it is judged that only either of the two APSs has failed, in step A90 it is judged whether or not the brake switch 200 is on, i.e., whether or not the braking operation has been performed. Then, if the braking operation has been performed, the process will advance to step A100 and a throttle opening angle instruction value will be clipped at a predetermined upper limit value. In this manner, the intake air volume is suppressed, thereby suppressing the engine output.

Therefore, if a failure of one accel position senor is judged, the upper limit value of the opening angle of the throttle value is clipped by operation of the brake. Hence, thereafter, even in the case where failure judgment is not performed although the other accel position sensor has failed, unpredictable motion of the throttle valve can be prevented and therefore there is an advantage of being able to enhance vehicle safety.

Also, even in the case where the other accel position sensor is normal, when one accel position sensor fails, the upper limit value of the opening angle of the throttle valve is clipped if operation of the brake is detected. Therefore, there is another advantage that a change in the engine output causes the driver to recognize an abnormality in the vehicle and urges the driver to an early repair of the vehicle. With this, there is a further advantage of enhancing reliability and safety of the drive by wire 150.

If a brief description is made of reset conditions for failure judgment, the reset conditions are that the ignition key is turned off and the battery is turned off. In the case where the aforementioned control is repeated during re-travel and also it is rejudged that the DBW is normal, a return to normal operation is made. At this time, if failure contents are stored in a computer as failure information, rechecking of the DBW system can be performed when the vehicle is checked.

In the aforementioned embodiment, although a description has been made of the case where the control apparatus according to the present invention is applied to an in-cylinder injection internal combustion engine, the control apparatus is not limited to an embodiment such as this but is widely applicable to vehicles equipped with an electronic throttle control apparatus and a plurality of sets of electronic throttle control systems.

We claim:

1. A control apparatus for an internal combustion engine having a throttle valve and an accelerator pedal, comprising:

a plurality of electronic throttle control systems for electrically driving the throttle valve of the internal combustion engine based on a degree of operation of the accelerator pedal;

failure judgment means for determining failure states for the plurality of electronic throttle control systems, the failure judgment means being structured and arranged to determine whether each of the plurality of electronic throttle control systems have failed individually;

intake air volume control means for driving the throttle valve in a closing direction and also for supplying a predetermined intake air volume to the internal combustion engine when the failure judgment means determines that all of the electronic throttle control systems have failed; and output suppression means for controlling the driving of the throttle valve by an electronic throttle control system that has not failed and also suppressing output of the internal combustion engine corresponding to the the degree of operation of the accelerator pedal when the failure judgment means determines that at least one but not all of the plural electronic throttle control systems has failed.

2. The control apparatus for an internal combustion engine as set forth in claim 1, wherein the electronic throttle control systems each comprise:

accelerator opening angle detection means for detecting the degree of the operation of the accelerator pedal, an actuator for opening or closing the throttle valve based on a result of a detection made by the accelerator opening angle detection means, and throttle opening angle detection means for detecting an opening angle of the throttle valve; and wherein at least one of among the accelerator opening angle detection means, the actuator, and the throttle opening angle detection means is provided in each of the plurality of electronic throttle control systems, respectively.

3. The control apparatus for an internal combustion engine as set forth in claim 1, further comprising:

a brake switch for detecting an operating state of a brake; and regulation means for regulating an upper limit of the opening angle of the throttle valve if at least one but less than all of the electronic throttle control systems is determined to have failed by the failure judgment means and also if the operation of the brake is detected by the brake switch.

4. The control apparatus for an internal combustion engine as set forth in claim 1, wherein the plurality of electronic throttle control systems each include at least accelerator opening angle detection means for detecting the degree of the operation of the accelerator pedal, respectively; and wherein the failure judgment means determines failures of the electronic throttle control systems based on a difference in detection information obtained by the plurality of accelerator opening angle detection means.

5. A control apparatus for an internal combustion engine having a throttle valve and an accelerator pedal, comprising:

a plurality of electronic throttle control systems for electrically driving the throttle valve of the internal combustion engine based on a degree of operation of the accelerator pedal;

failure judgment means for determining failure states for the plurality of electronic throttle control systems, the failure judgment means being structured and arranged to determine whether each of the plurality of electronic throttle control systems have failed individually; and output suppression means for controlling the driving of the throttle valve by an electronic throttle control system that has not failed and also suppressing output of the internal combustion engine corresponding to the degree of operation of the accelerator pedal when the failure judgment means determines that at least one but not all of the plural electronic throttle control systems has failed.

6. The control apparatus for an internal combustion engine as set forth in claim 5, wherein the electronic throttle control systems each comprise:

accelerator opening angle detection means for detecting the degree of the operation of the accelerator pedal, an actuator for opening or closing the throttle valve based on a result of a detection made by the accelerator opening angle detection means, and throttle opening angle detection means for detecting an opening angle of the throttle valve; and wherein at least one of among the accelerator opening angle detection means, the actuator, and the throttle opening angle detection means is provided in each of the plurality of electronic throttle control systems, respectively.

7. The control apparatus for an internal combustion engine as set forth in claim 5, further comprising:

a brake switch for detecting an operating state of a brake; and regulation means for regulating an upper limit of the opening angle of the throttle valve if at least one but less than all of the electronic throttle control systems is determined to have failed by the failure judgment means and also if the operation of the brake is detected by the brake switch.

8. The control apparatus for an internal combustion engine as set forth in claim 5, wherein the plurality of electronic throttle control systems each include at least accelerator opening angle detection means for detecting the degree of the operation of the accelerator pedal, respectively; and wherein the failure judgment means determines failures of the electronic throttle control systems based on a difference in detection information obtained by the plurality of accelerator opening angle detection means.

9. A control apparatus for an internal combustion engine having a throttle valve and an accelerator pedal, comprising:

a plurality of electronic throttle control systems for electrically driving the throttle valve of the internal combustion engine based on a degree of operation of the accelerator pedal;

a failure detector structured and arranged to determine failure states for the plurality of electronic throttle control systems, the failure detector being structured and arranged to determine whether each of the plurality of electronic throttle control systems have failed individually;

an intake air volume controller structured and arranged to drive the throttle valve in a closing direction and also for supplying a predetermined intake air volume to the internal combustion engine when the failure judgment detector determines that all of the electronic throttle control systems have failed; and an output suppressing device structured and arranged to control the driving of the throttle valve by an electronic throttle control system that has not failed and also suppressing output of the internal combustion engine corresponding to the degree of operation of the accelerator pedal when the failure detector determines that at least one but not all of the plural electronic throttle control systems has failed.

10. The control apparatus for an internal combustion engine as set forth in claim 9, wherein the electronic throttle control systems each comprise:

an accelerator opening angle detector structured and arranged to detect a degree of operation of the accelerator pedal, an actuator for opening or closing the throttle valve based on a result of a detection made by the accelerator opening angle detector, and a throttle opening angle detector structured and arranged to detect an opening angle of the throttle valve; and wherein at least one of among the accelerator opening angle, the actuator, and the throttle opening angle detector is provided in each of the plurality of electronic throttle control systems, respectively.

11. The control apparatus for an internal combustion engine as set forth in claim 9, further comprising:

a brake switch for detecting an operating state of a brake; and a regulator structured and arranged to regulate an upper limit of the opening angle of the throttle valve if electronic throttle control systems is determined to have failed by the failure detector and also if the operation of the brake is detected by the brake switch.

12. The control apparatus for an internal combustion engine as set forth in claim 9, wherein the plurality of electronic throttle control systems each include at least accelerator opening angle detector for detecting the degree of the operation of the accelerator pedal, respectively; and wherein the failure detector determines failures of the electronic throttle control systems based on a difference in detection information obtained by the plurality of accelerator opening angle detector.

13. A control apparatus for an internal combustion engine having a throttle valve and an accelerator pedal, comprising:

a plurality of electronic throttle control systems for electrically driving the throttle valve of the internal combustion engine based on a degree of operation of the accelerator pedal;

a failure detector structured and arranged to determine failure states for the plurality of electronic throttle control systems, the failure detector being structured and arranged to determine whether each of the plurality of electronic throttle control systems have failed individually; and an output suppressing device structured and arranged to control the driving of the throttle valve by an electronic throttle control system that has not failed and also suppressing output of the internal combustion engine corresponding to the degree of operation of the accelerator pedal when the failure detector determines that at least one but not all of the plural electronic throttle control systems has failed.

14. The control apparatus for an internal combustion engine as set forth in claim 13, wherein the electronic throttle control systems each comprise:

an accelerator opening angle detector structured and arranged to detect a degree of operation of the accelerator pedal, an actuator for opening or closing the throttle valve based on a result of a detection made by the accelerator opening angle detector, and a throttle opening angle detector structured and arranged to detect an opening angle of the throttle valve; and wherein at least one of among the accelerator opening angle detector, the actuator, and the throttle opening angle detector is provided in each of the plurality of electronic throttle control systems, respectively.

15. The control apparatus for an internal combustion engine as set forth in claim 13, further comprising:

a brake switch for detecting an operating state of a brake; and a regulator structured and arranged to regulate an upper limit of the opening angle of the throttle valve if at least one but less than all of the electronic throttle control systems is determined to have failed by the failure detector and also if the operation of the brake is detected by the brake switch.

16. The control apparatus for an internal combustion engine as set forth in claim 13, wherein the plurality of electronic throttle control systems each include at least accelerator opening angle detector for detecting the degree of the operation of the accelerator pedal, respectively; and wherein the failure detector determines failures of the electronic throttle control systems based on a difference in detection information obtained by the plurality of accelerator opening angle detector.

* * * * *